US011771968B2

(12) United States Patent
Wang

(10) Patent No.: US 11,771,968 B2
(45) Date of Patent: Oct. 3, 2023

(54) METHOD OF MANUFACTURING RACKET GRIP 3D-TAPE

(71) Applicant: HIGH CEDAR ENTERPRISE CO., LTD., Taichung (TW)

(72) Inventor: Yung-Han Wang, Taichung (TW)

(73) Assignee: HIGH CEDAR ENTERPRISE CO., LTD., Taichung (TW)

( * ) Notice: Subject to any disclaimer, the term of this patent is extended or adjusted under 35 U.S.C. 154(b) by 335 days.

(21) Appl. No.: 17/140,435

(22) Filed: Jan. 4, 2021

(65) Prior Publication Data

US 2022/0161110 A1 May 26, 2022

(30) Foreign Application Priority Data

Nov. 24, 2020 (TW) ..... 109141192

(51) Int. Cl.
*A63B 60/14* (2015.01)
*A63B 49/08* (2015.01)

(52) U.S. Cl.
CPC ..... *A63B 60/14* (2015.10); *A63B 49/08* (2013.01)

(58) Field of Classification Search
CPC ..... A63B 60/14; A63B 49/08
See application file for complete search history.

(56) References Cited

U.S. PATENT DOCUMENTS

2002/0142857 A1* 10/2002 Huang ..... A63B 53/14 473/300
2003/0150081 A1* 8/2003 Wang ..... A63B 60/06 16/110.1
2003/0157991 A1* 8/2003 Huang ..... A63B 53/14 473/300
2003/0228930 A1* 12/2003 Huang ..... A63B 60/10 473/301
2008/0237937 A1* 10/2008 Aaron ..... A63B 59/50 473/564
2022/0161110 A1* 5/2022 Wang ..... A63B 49/08

FOREIGN PATENT DOCUMENTS

CN 1467008 A * 1/2004 ..... A63B 49/08
WO WO-2012014166 A1 * 2/2012 ..... A62B 35/00
WO WO-2020176800 A1 * 9/2020 ..... A63B 53/14

* cited by examiner

*Primary Examiner* — Raleigh W Chiu
(74) *Attorney, Agent, or Firm* — Muncy, Geissler, Olds & Lowe, P.C.

(57) ABSTRACT

Provided is a method of manufacturing a racket grip 3D-tape, which entails coating a substrate with polyurethane of at least two different densities. Heavier polyurethane sinks, but lighter polyurethane rises, thereby resulting in unevenness of the surface of the racket grip 3D-tape.

6 Claims, 5 Drawing Sheets

METHOD OF MANUFACTURING RACKET GRIP 3D-TAPE

BACKGROUND OF THE INVENTION

1. Field of the Invention

The present disclosure relates to racket grip tapes and, more particularly, to a method of manufacturing a racket grip 3D-tape.

2. Description of the Related Art

Plenty of players wrap the grip of a racket with a racket grip tape to augment liquid absorption capability thereof and increase friction on the surface of the racket grip with a view to enabling them to grip the racket firmly. Existing commercially-available racket grip tapes are manufactured mostly by coating a substrate made of woven fabric or non-woven fabric with polyurethane (PU). Patterns and logos are printed on the racket grip tapes in inks of different colors in order to render the racket grip tapes visually attractive. However, the racket grip tapes thus manufactured have drawbacks.

First, with the patterns and logos being printed on the surface of the racket grip tapes in inks of different colors, the inks block the otherwise liquid-permeable pores in the racket grip tapes to the detriment of the liquid absorption capability thereof.

Second, the surfaces of the racket grip tapes are flat and smooth despite the patterns and logos thereon and thus have little friction. The racket grip tapes exhibit a much lower surface friction when they come into contact with sweat or rainwater.

BRIEF SUMMARY OF THE INVENTION

It is an objective of the present disclosure to provide a method of manufacturing a racket grip 3D-tape and increase the surface friction of the racket grip 3D-tape through its 3D structure.

Another objective of the present disclosure is to provide a method of manufacturing a racket grip 3D-tape, such that the racket grip 3D-tape is made colorful without concealing the surface of polyurethane to the detriment of the liquid absorption capability thereof.

In order to achieve the above and other objectives, the present disclosure provides a method of manufacturing a racket grip 3D-tape, which entails coating a substrate with polyurethane of at least two different densities, setting the polyurethane, thereby rendering one side of the racket grip tape uneven rather than flat.

Preferably, the substrate is coated with the polyurethane of different densities in different instances.

Preferably, the substrate is coated with the polyurethane of different densities in one single instance.

Preferably, the polyurethane of different densities has at least two different colors.

DETAILED DESCRIPTION OF THE INVENTION

The technical features disclosed in the present disclosure are not restricted to specific structures, purposes and applications thereof described herein. The wording used herein is illustrative and comprehensible to persons skilled in the art. Directional expressions used herein, such as "front," "up," "down," "rear," "left," "right," "top," "bottom," "inner" and "outer," are exemplary, descriptive terms which must be interpreted from a layman's perspective and must not be restrictive of the appended claims of the present disclosure.

Singular quantitative expressions used in the appended claims of the present disclosure, such as "a," "an," "one" and "the," must be interpreted in such a manner to include their plural forms. For example, the expression "a component" must be interpreted in such a manner to mean "one or more components" and include equivalent substitutes well-known among persons skilled in the art. All conjunctions used under similar conditions must be given the broadest interpretation. Specific shapes and structural features described herein and technical terms used herein must be interpreted in such a manner to encompass equivalent substitute structures or techniques which achieve the same functions as the specific structures described herein or technical terms used herein.

Figure 1:
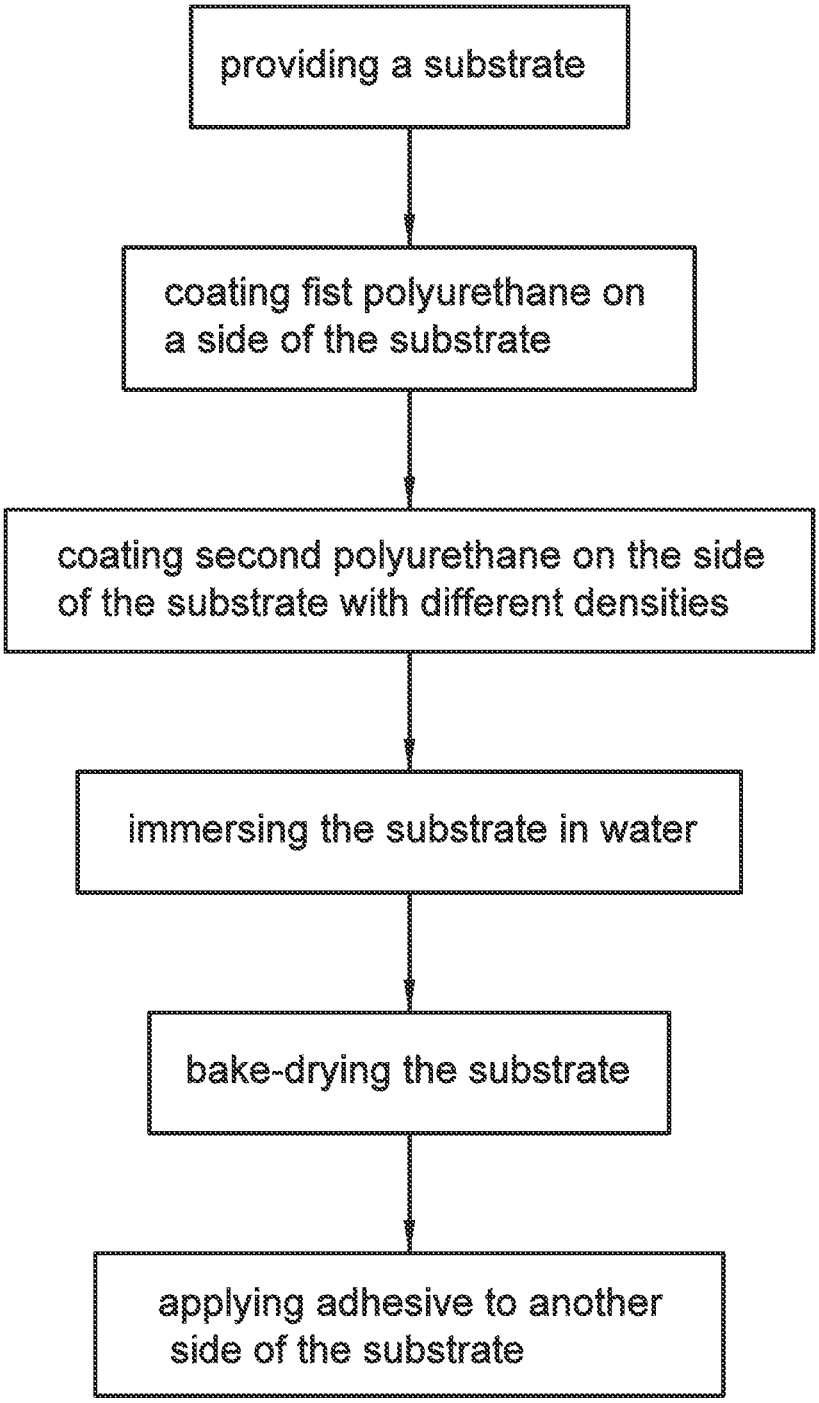
FIG. 1 is a schematic view of the process flow of a method of manufacturing a racket grip 3D-tape according to the first embodiment of the present disclosure.
Figure 2:
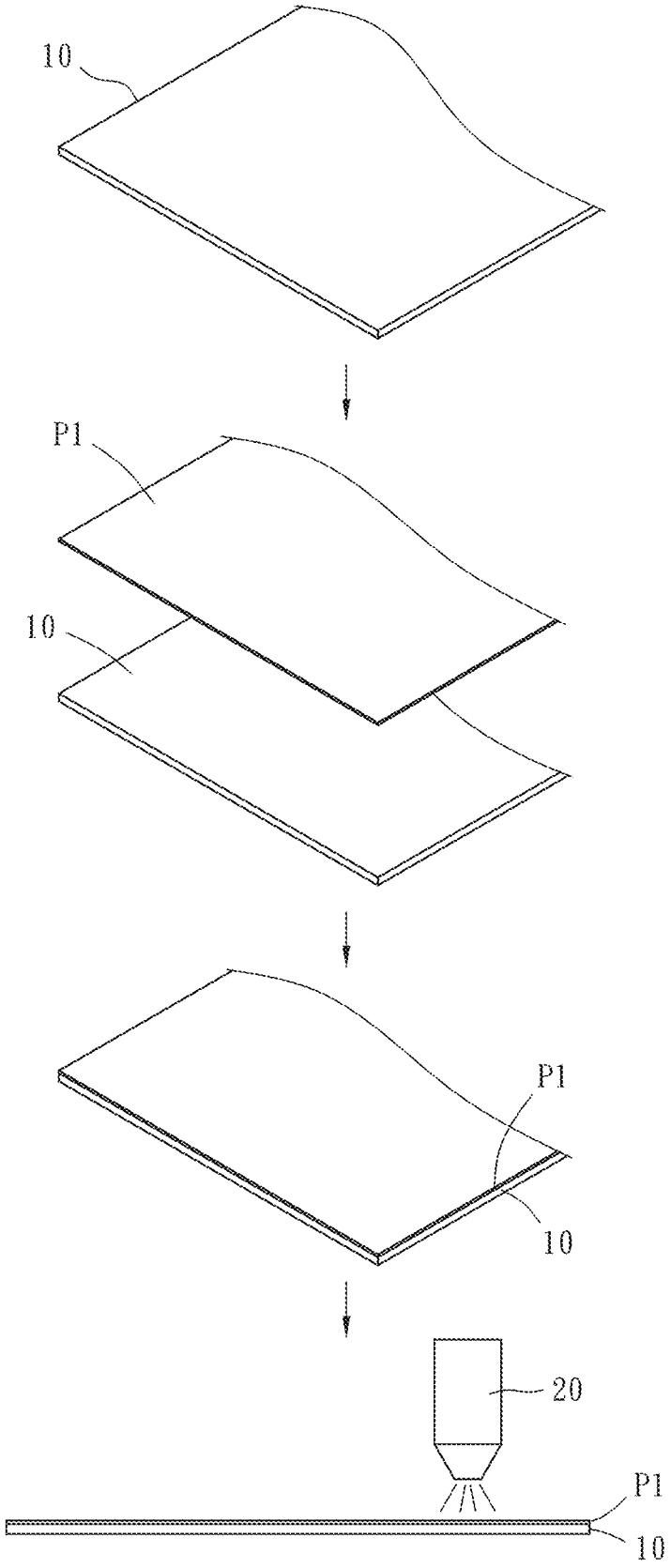
FIG. 2 is a schematic view of the method of manufacturing a racket grip 3D-tape according to the first embodiment of the present disclosure.
Figure 3:
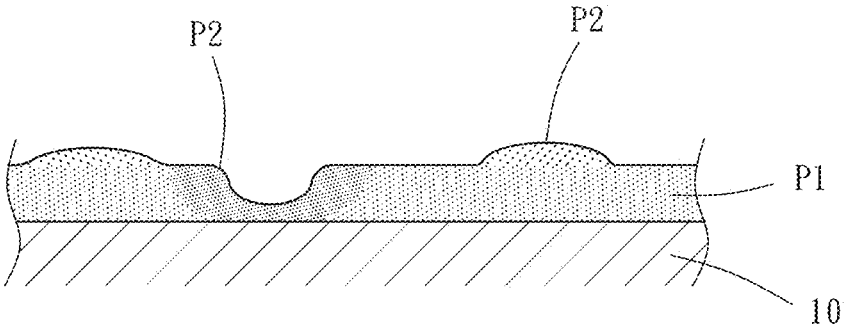
FIG. 3 is a cross-sectional view of a racket grip tape according to the first embodiment of the present disclosure.

Referring to FIG. 1 through FIG. 3, a method of manufacturing a racket grip 3D-tape according to the first embodiment of the present disclosure comprises the steps as follows:

Step A: provide a substrate 10. The substrate 10 is made of non-woven fabric, woven fabric, cotton, hemp, polyester or rubber.

Step B: coat one side of the substrate 10 with polyurethane P1 in the first instance. The side of the substrate 10 is coated with polyurethane P1 in the first instance by spraying, pouring or impregnation.

Step C: coat the side of the substrate 10 with polyurethane P2 in the second instance. Polyurethane P2 coated in the second instance is on the same side of the substrate 10 as polyurethane P1 coated in the first instance but of different, i.e., higher or lower, density than polyurethane P1 coated in the first instance. For example, polyurethane P1 coated in the first instance is of a density of 1 g/cm$^3$, but polyurethane P2 coated in the second instance is of a higher density of 1.3 g/cm$^3$ or a lower density of 0.8 g/cm$^3$. Polyurethane P2 of the second instance is fed onto polyurethane P1 of the first instance with a feeding head 20. The feeding head 20 is in the number of one or in a plural number. The feeding heads 20 feed polyurethane of the same density. Alternatively, the feeding heads 20 feed polyurethane of different densities, respectively. The polyurethane is, whether in the first instance or in the second instance, molten polyurethane which looks like malt sugar and thus cannot be quickly and evenly mixed and spread by a mixing process. Since the polyurethane used in the first and second instances is of different densities, heavier polyurethane sinks, but lighter polyurethane rises, thereby resulting in unevenness of the surface of the polyurethane. Furthermore, the uneven side of the polyurethane will be visually attractive when colorful.

Step D: immerse the polyurethane-coated substrate 10 in a water bath to set the polyurethane by water bathing.

Step E: bake-dry, upon completion of step D, the substrate 10 by bake-drying the substrate 10 in an oven.

Step F: apply adhesive to the other side of the substrate 10, affix release paper thereto, and cut the substrate 10 into strips, thereby finalizing the manufacturing of a racket grip tape.

Figure 5:
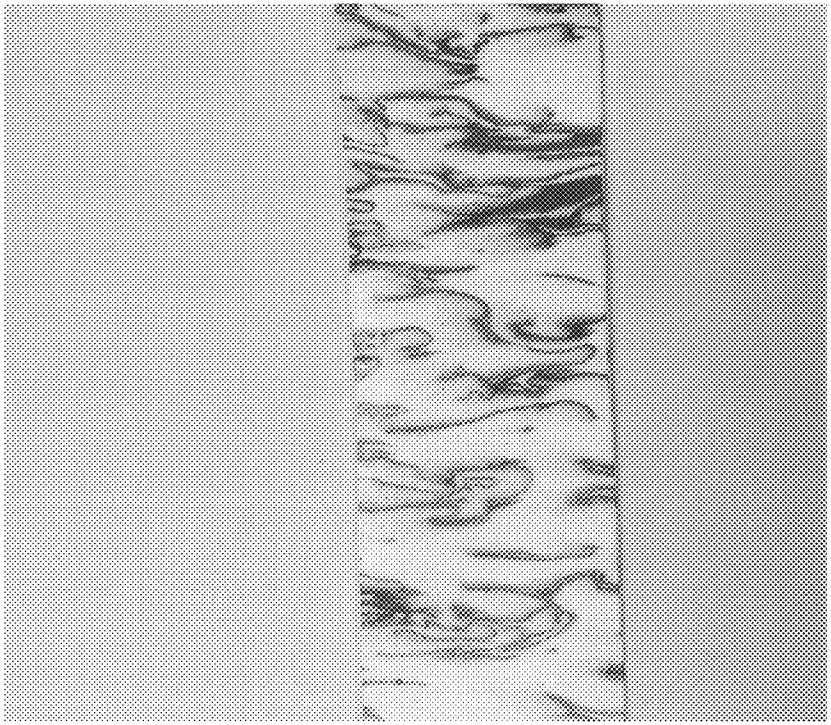
FIG. 5 shows a picture taken of the racket grip 3D-tape of the present disclosure.

The method of manufacturing a racket grip 3D-tape according to the first embodiment of the present disclosure is effective in manufacturing a racket grip 3D-tape (shown in FIG. 5) which has an uneven surface with enhanced friction. Furthermore, the surface of the racket grip tape is not covered with any printing ink which might otherwise deteriorate the liquid absorption capability of the racket grip tape.

Figure 4:
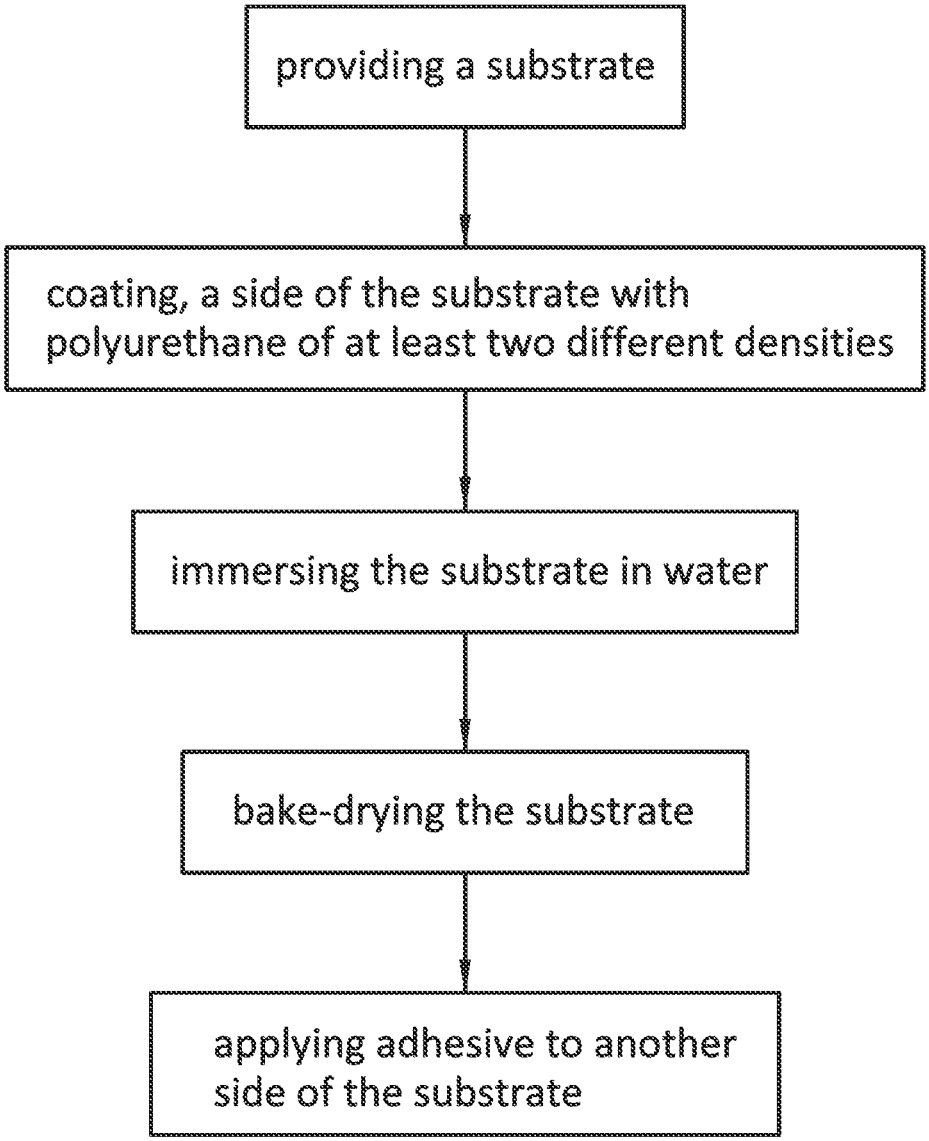
FIG. 4 is a schematic view of the process flow of a method of manufacturing a racket grip 3D-tape according to the second embodiment of the present disclosure.

Referring to FIG. 4, a method of manufacturing a racket grip 3D-tape according to the second embodiment of the present disclosure comprises the steps described below.

Step A: provide a substrate 10. The substrate 10 is made of non-woven fabric, woven fabric, cotton, hemp or polyester.

Step G: coat, with a feeding head 20, one side of the substrate 10 with polyurethane of at least two different densities. For example, the side of the substrate 10 is coated with polyurethane of three different densities, using three different feeding heads 20, respectively.

Step D: impregnate the polyurethane-coated substrate 10 in a water bath to set the polyurethane by water bathing.

Step E: bake-dry the otherwise water-impregnated substrate 10 in an oven.

Step F: apply adhesive to the other side of the substrate 10, affix release paper thereto, and cut the substrate 10 into strips, thereby finalizing the manufacturing of a racket grip tape.

Compared with the first embodiment, the second embodiment has the distinguishing technical features as follows: the method of manufacturing a racket grip 3D-tape entails coating the substrate 10 with polyurethane in one single instance rather than two instances, that is, coating one side of the substrate 10 with polyurethane of at least two different densities in the same step; with the polyurethane being of at least two different densities, heavier polyurethane sinks, but lighter polyurethane rises, thereby resulting in unevenness of the surface of the polyurethane.

The manufacturing method of the present disclosure is effective in manufacturing a racket grip 3D-tape with an uneven side to enhance friction thereof. Furthermore, the racket grip 3D-tape thus manufactured is colorful and thereby visually attractive without concealing the surface of polyurethane.

What is claimed is:

1. A method of manufacturing a racket grip 3D-tape, comprising:

step A, providing a substrate;

step B, coating a side of the substrate with polyurethane in a first instance;

step C, coating the side of the substrate with polyurethane in a second instance, wherein the polyurethane coated in the first instance and the polyurethane coated in the second instance are on the same side of the substrate but of different densities;

step D, immersing the polyurethane-coated substrate in water to set the polyurethane by water bathing;

step E, bake-drying the water-immersed substrate; and step F, applying adhesive to another side of the substrate, affixing release paper thereto, and cutting the substrate into strips, wherein the polyurethane coated in the second instance in step C is of higher density than the polyurethane coated in the first instance in step B, and wherein the polyurethane coated in the second instance in step C is fed with a feeding head onto the polyurethane coated in the first instance in step B.

2. A method of manufacturing a racket grip 3D-tape, comprising:

step A, providing a substrate;

step B, coating a side of the substrate with polyurethane in a first instance;

step C, coating the side of the substrate with polyurethane in a second instance, wherein the polyurethane coated in the first instance and the polyurethane coated in the second instance are on the same side of the substrate but of different densities;

step D, immersing the polyurethane-coated substrate in water to set the polyurethane by water bathing;

step E, bake-drying the water-immersed substrate; and step F, applying adhesive to another side of the substrate, affixing release paper thereto, and cutting the substrate into strips, wherein the polyurethane coated in the second instance in step C is of lower density than the polyurethane coated in the first instance in step B, and wherein the polyurethane coated in the second instance in step C is fed with a feeding head onto the polyurethane coated in the first instance in step B.

3. The method of manufacturing a racket grip 3D-tape according to claim 1, wherein the side of the substrate is coated with the polyurethane in the first instance in step B by spraying, pouring or impregnation.

4. A method of manufacturing a racket grip 3D-tape, comprising:

step A, providing a substrate;

step G, coating, with a feeding head, a side of the substrate with polyurethane of at least two different densities;

step D, impregnating the polyurethane-coated substrate with water to set the polyurethane by water bathing;

step E, bake-drying the water-impregnated substrate; and step F, applying adhesive to another side of the substrate, affixing release paper thereto, and cutting the substrate into strips.

5. The method of manufacturing a racket grip 3D-tape according to claim 4, wherein one side of the substrate is coated with polyurethane of different densities with different feeding heads, respectively.

6. The method of manufacturing a racket grip 3D-tape according to claim 5, wherein the substrate is made of non-woven fabric, woven fabric, cotton, hemp or polyester.

* * * * *